United States Patent [19]

Omholt

[11] Patent Number: 4,638,698

[45] Date of Patent: Jan. 27, 1987

[54] DROP FEED MITERING MACHINE

[75] Inventor: Bruce D. Omholt, Rohnert Park, Calif.

[73] Assignee: Prints Plus, Inc., Martinez, Calif.

[21] Appl. No.: 834,623

[22] Filed: Feb. 28, 1986

[51] Int. Cl.[4] ..... B27G 5/04

[52] U.S. Cl. ..... 83/444; 144/217; 83/466.1; 83/468; 83/523; 83/581; 83/620

[58] Field of Search ..... 83/468, 467 R, 466.1, 83/444, 581, 558, 562, 411 A, 401, 520; 144/217, 216

[56] References Cited

U.S. PATENT DOCUMENTS

| | | | |
|---|---|---|---|
| 1,083,052 | 12/1913 | Bowman | 83/468 |
| 1,087,715 | 2/1914 | Bowman | 83/468 |
| 4,193,331 | 3/1980 | Gathings | 83/581 X |

*Primary Examiner*—Frank T. Yost

*Attorney, Agent, or Firm*—Donald L. Beeson

[57] ABSTRACT

A drop feed mitering machine includes a work table positioned in a near vertical orientation, a cutting throat running perpendicularly through the machine and a drop feed guide mounted in the region of the cutting throat for guiding a length of molding stock over the cutting throat in a simple gravity assisted drop feed operation. A cutter block is actuated from the front of the machine to sever the molding section positioned over the cutting throat and a front removable scrap bin is provided for removing scraps produced by the cutter block during mitering operations. A feed stop positioned below the feed guide is adjusted to determine the length of the molding piece to be cut. The drop feed machine of the invention can be operated in a confined space because the horizontal feed operations and the horizontally extending feed structures of conventional mitering machines are eliminated.

17 Claims, 7 Drawing Figures

DROP FEED MITERING MACHINE

BACKGROUND OF THE INVENTION

The present invention generally relates to tools for making precise angled cuts in molding sections, and more particularly it relates to an improved mitering machine design that will permit precision mitering operations to take place in very confined spaces, such as in the back of small retail shops where there is a need to cut molding sections for picture frames or the like.

Miter joints are required in numerous applications. One application is in the fabrication of picture or poster frames where four molding sections are cut to length with matching mitered ends. Different mitering machines have been devised for making angled cuts quickly and accurately. One such machine is disclosed in U.S. Pat. No. 4,208,934 issued to Leslie W. Wall, wherein the molding section is supported on a horizontal work table and cut by a pair of motor driven rotary saw blades positioned in vertical relation to the table at opposed 45° cutting angles. In another prior art mitering machine design a V-shaped cutter block carrying cutting knives is caused to strike in a cutting action downwardly through a cutting throat in the horizontal work table so as to cut V-shaped notches in the molding section. The cutter block can be advanced incrementally to make increasingly larger V-shaped cuts until the molding section is severed. The two resulting severed pieces have precise matching and oppositely angled mitered ends, which are generally produced without chipping or splinting of the wood.

The disadvantage of the above-described conventional machines is that they require considerable floor area to operate due in part to the lateral extension of the horizontal work table on which the molding sections are placed for cutting. This makes such machines difficult if not impossible to operate in confined spaces, and thus makes their speed and accuracy or generally unavailable on-site in small retail shops that sell frames or pre-framed pictures or posters.

The present invention is directed to an improved mitering machine design that can be operated in confined spaces and that at the same time can provide the same accuracy and production speed advantages of the foregoing conventional designs.

SUMMARY OF THE INVENTION

In accordance with the present invention, a drop feed mitering machine is provided wherein the molding sections to be cut for mitered joints are fed essentially vertically through the machine. The machine is totally front operated in that molding material is fed from the front, and the machine is adjusted from the front and cleaned from the front; in normal operation there is no need to be behind the machine.

The mitering machine of the invention is comprised essentially of an elongated work table that extends upwardly from a mounting base in a near vertical orientation. The front plane of the work table defines the front of the machine and serves to support and guide the molding sections into position for cutting. The work table has a cutting throat running through it intermediate the table's top and bottom ends and means accessible from the front of the mitering machine are provided for drop feeding a length of material, such as a molding section, downwardly along the plane of the table over the cutting throat to a predetermined length. The cutting element is moveably mounted to pass through the cutting throat in a cutting action that is perpendicular to the plane of the work table and that cuts the molding section at a predetermind angle.

As will readily be seen by thwe following description of the preferred embodiment, the drop feed operation for positioning the molding section to be cut is a simple gravity feed whereby, after being severed by the cutting element, the cut piece of molding is easily removed from the front of the machine from below the cutting throat.

In the preferred embodiment illustrated herein the cutting element is comprised of a V-shaped cutter block mounted for movement in two different directions: in one direction the cutter block incrementally advances in the plane of the work table into a V-slot extending into the side of the table. (The cutting throat is formed by the apex of this V-slot.) In another direction the cutter block is moveably mounted to strike through the V-slot to provide a short front to back cutting or punching like action through the cutting throat. This cutting action is perpendicular to the front plane of the work table. Means for operating the cutter block, both to advance it into the throat and to actuate it in its cutting action, are provided so as to be accessible from the front of the machine. Thus, the cutter block can be operated by an operator standing in front of the substantially vertically upright machine to cut progressively larger V-shaped notches in a molding section until the molding is severed. The severed ends of the molding section will have clean matching angled cuts for producing an accurate miter joint.

Further, in the preferred embodiment the drop feed means for positioning the molding section at a predetermined length over the cutting throat of the work table is comprised of a drop feed guide mounted to the work table in the region of the cutting throat and a molding feed stop adjustably positioned below the feed guide substantially the plane of the work table. The drop feed guide has a feed channel adapted to guide a molding section fed therethrough downwardly along the plane of the work table over the cutting throat. The adjustable feed stop receives the end of the molding section when it is droped through the drop feed guide, thereby determining the length of the molding piece to be cut.

Therefore, it will readily be appreciated that it is a primary object of the present invention to provide a mitering machine that can be operated in a very confined space by providing a machine wherein long molding sections to be cut do not have to be fed from the side of the machine on a conventional horizontal work plane. The machine of the invention has the particular advantage in that it is easy to use: the feeding of molding stock into the machine involves a quick, gravity assisted hand operation that permits the molding to drop into a substantially self-aligning cutting position over the substantially horizontally oriented cutting throat of the work table. Other objects of the invention will be appreciated from the following description of the preferred embodiment which is illustrated in the accompanying drawings.

DETAILED DESCRIPTION OF THE PREFERRED EMBODIMENT

Figure 3:
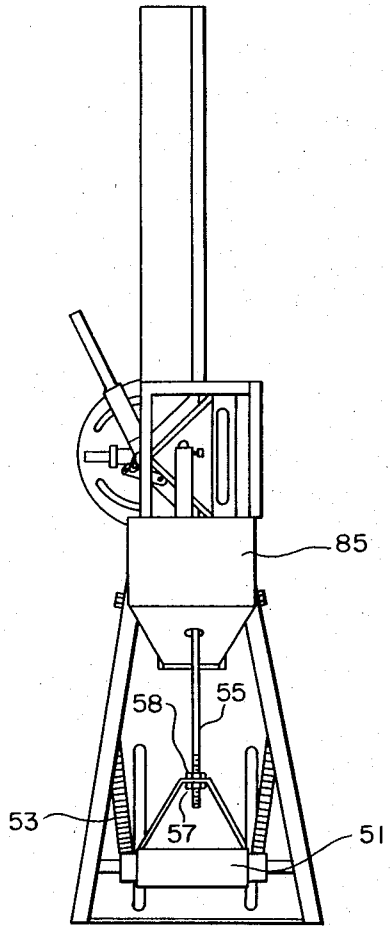
FIG. 3 is a rear elevational view thereof.
Figure 2:
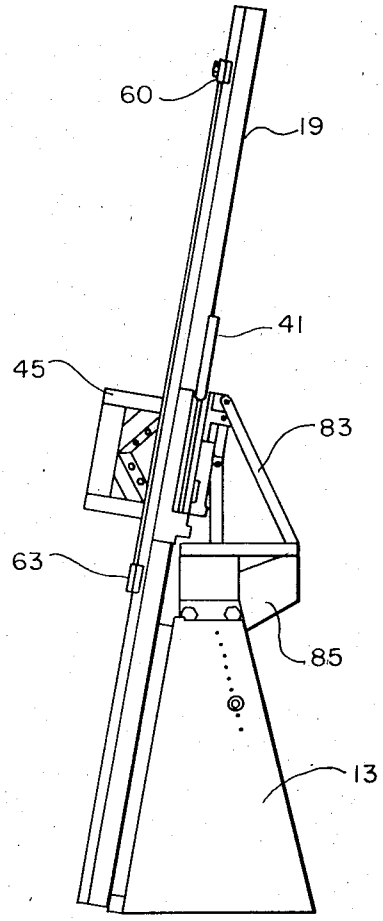
FIG. 2 is a right side elevational view thereof.
Figure 1:
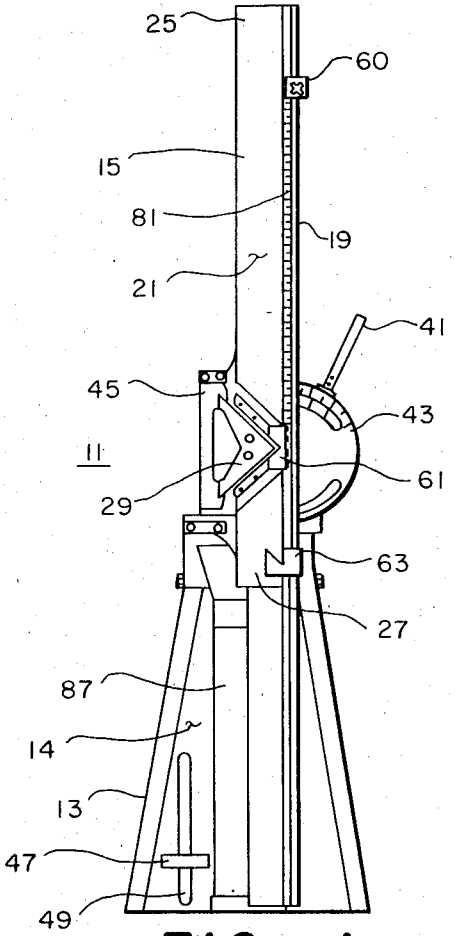
FIG. 1 is a front elevational view of a drop feed mitering machine in accordance with the present invention.

Referring now to the drawing, and initially to FIGS. 1–3, the mitering machine of the invention, which is generally denoted by the numeral 11, includes a base 13 and a work table 15 that extends in a near vertical orientation upwardly from the base. It is best seen in FIG. 2, the work table actually has a slight inclination from the vertical of about 10 degrees thereby permitting molding sections fed into the machines to readily be inclined against and guided along the work table. The work table is generally defined by top and bottom ends 25, 27, a first inside edge 17, a second outside edge 19, and a front plane 21. The front plane 21 of the work table defines the front of the mitering machine from which the mitering machine will be operated as hereinafter described.

The invention generally provides that a cutting element pass through a cutting throat 23 in the work table located intermediate the worktable's top and bottom ends 25, 27. In the preferred embodiment, the cutting element is seen to be in the form of a cutter block 29 moveably mounted to pass through the cutting throat in a cutting action which is perpendicular to the plane of the work table. In other words, with reference to FIG. 1, the cutting action of the cutting block is one that begins in front of the table and goes through the table until it bisects the plane of the table. Cutting blades 30, 31 are carried on the forward intersecting surfaces of the cutting block so as to cut or punch a V-shaped notch in the molding section positioned over the throat 23 of the work table.

It is seen that the cutting throat 23 is formed at the apex of a V-slot 33 which extends into the work table from its inside edge 17. Precision cutting blade guide bars 35, 37 attached by bolts 39 to the worktable structure line the V-slot at an appropriate angulation and cutting depth from the inside edge of the table.

Figure 4:
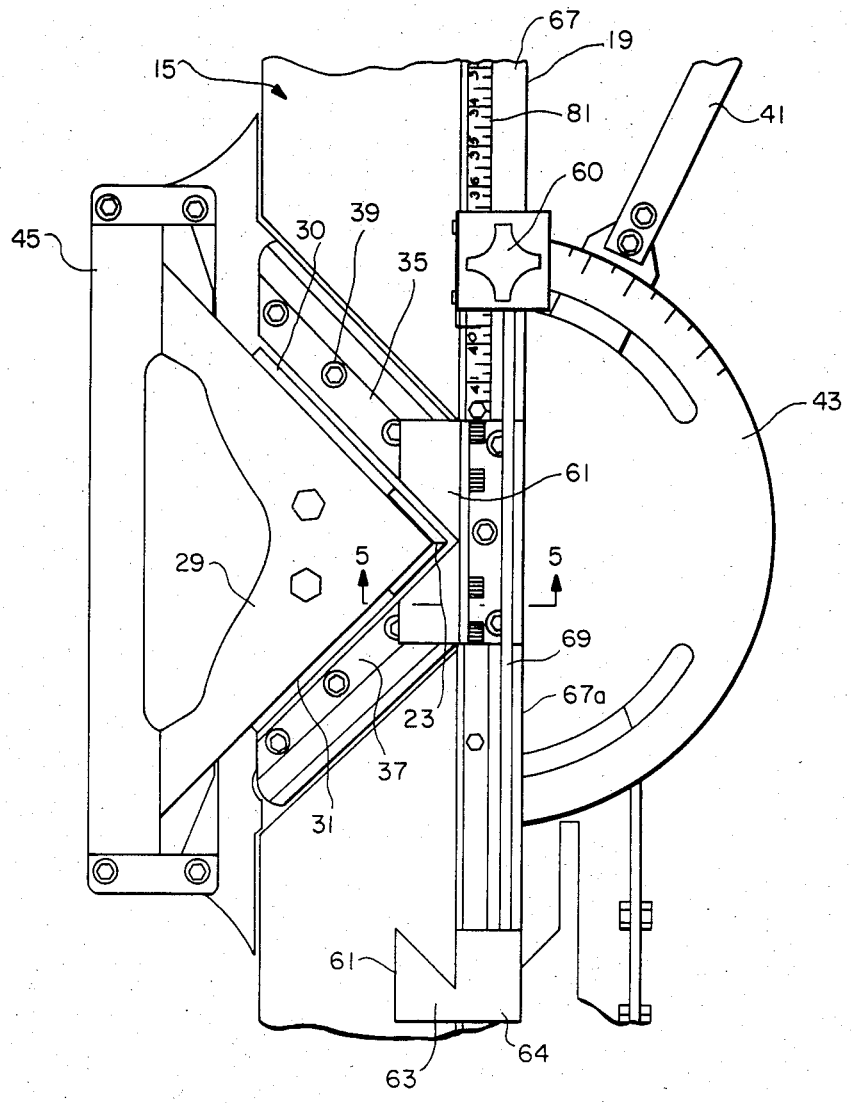
FIG. 4 is a partial view of the front of the drop feed mitering machine of the present invention showing in greater detail the arrangement of the cutter block and drop feed guide block.
Figure 4A:
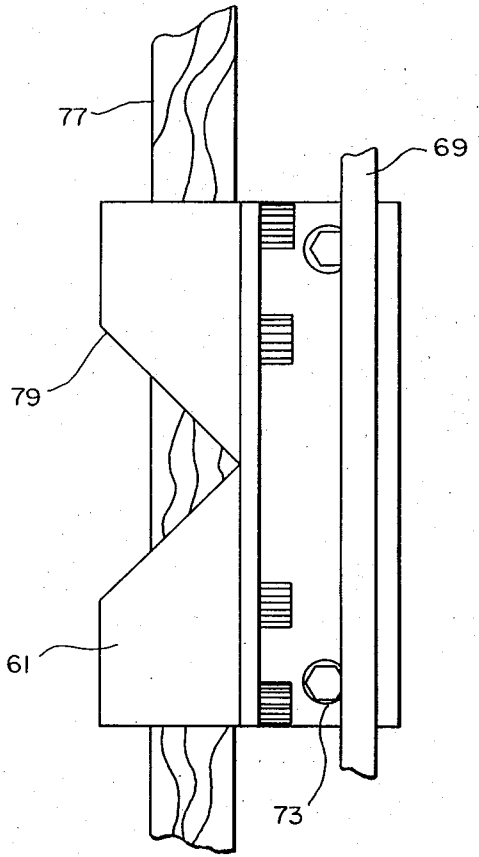
FIG. 4a is a front elevational view of the drop feed guide which is mounted to the work table, showing a molding section inserted therethrough.
Figure 6:
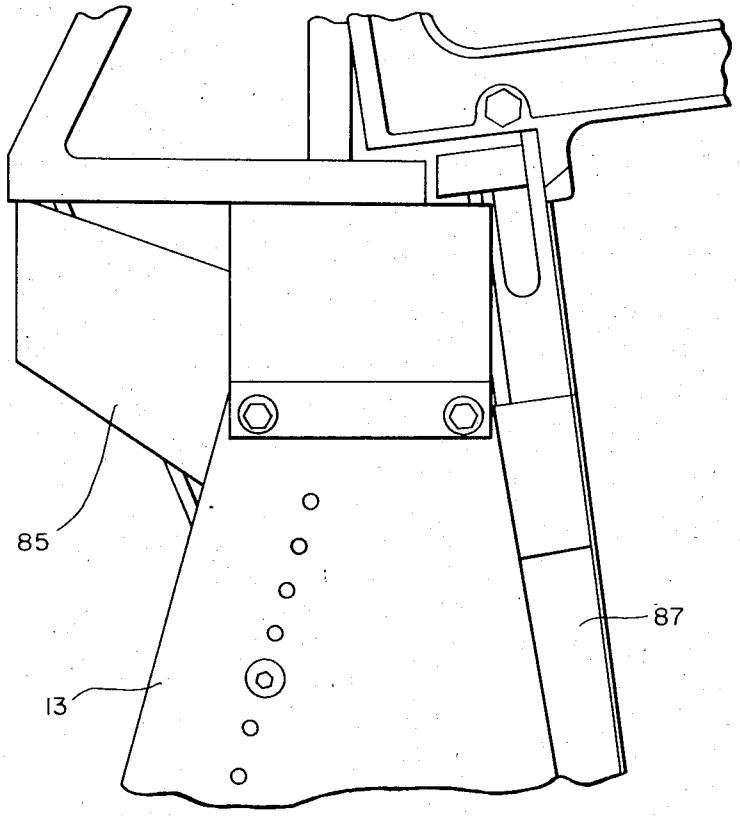
FIG. 6 is a partial view of the side of the mitering machine showing in greater detail the front accessible scrap bin.

As in existing mitering machines, means are provided for incrementally advancing the cutter block in the plane of the work table into the cutting throat 23 so that small, progressively deeper cuts, as generally illustrated by dashed lines in FIG. 4*a*, can be made in the molding section. This means for advancing the cutter block includes a front accessible advance lever 41 mounted to a vertical plate 43. The advance lever is operatively connected by suitable mechanical linkage (not shown) to the cutter block carriage frame 45 which is moveably mounted to the inside edge 17 of the work table. As hereinafter more fully described, the operator of the machine will control the depth of each cut by pulling the advance lever 41 upwardly in a center-clockwise direction.

Means for actuating the cutting element to pass in a cutting action through the cutting throat, a motion that is perpendicular to the cutting plane, is provided in the form of a foot pedal 47 extending through a vertical slot 49 in the front panel 14 of the machine's base 13. As best illustrated in FIG. 3 of the drawings, the foot pedal is operatively connected to rotate a rocker frame 51 behind and near the bottom of the base's front panel, with the rocker frame in turn being interconnected for moving the cutter block on the cutter block carriage frame 45 by means of connecting rod 55 having bottom threaded end 57. Suitable linkages (not shown) are provided for translating the substantially vertical motion of the connecting rod to substantially horizontal movement in the cutter block when the foot pedal 47 is depressed downwardly. The cutter block moves with a relatively short stroke into the cutting throat 23, enough to sever the molding over the throat. Compared to this the foot pedal travels a relatively large distance and the resulting multiplication of forces imparts large cutting forces to the cutter block. An adjustment nut 56 on the threaded end 57 of the connecting rod can be used to adjust the position of the cutter block.

Figure 5:
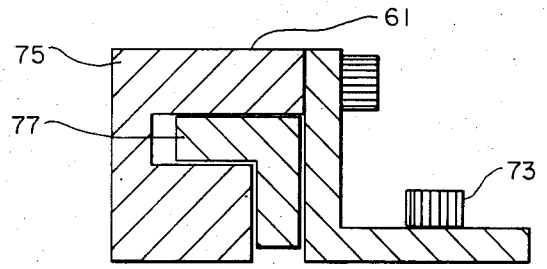
FIG. 5 is a cross-sectional view of the drop feed guide block shown in FIG. 4 taken along section lines 5—5.

Referring now to FIGS. 4 and 5, means accessible from the front of the mitering machine are provided for drop feeding a molding section downwardly along the plane of the work table 15 and over the cutting throat 23 to a predetermined length for the cut piece of molding. This drop feed means includes a drop feed guide 61 mounted to the outside edge 19 of the work table at the position of the cutting throat, a feed stop 63 positioned below the drop feed guide 61 substantially in the plane of the work table, an adjustment handle 65 slideably mounted to a slide member 67 extending along the outside edge 19 of the work table, and a connecting rod 69 which connects the feed stop 63 to the adjustment handle.

It is seen that the drop feed guide is formed by an "L" bracket 71 secured to the worktable's outer edge by means of mounting screws 73 and a guide block 75 in which there is formed a guide channel 77 in the shape of the molding stock to be handled by the drop feed guide. In the illustrated embodiment, the guide channel 77 is a right angle slot for receiving a right angle piece of molding 86 commonly used for fabricating picture frames. Guide blocks having guide channels of other shapes can be used to accommodate different shaped molding sections. Also a selection of different sized channels may need to be provided for diverse sizes of the same shape.

The center of the guide block 75 has a V-notch 79 that separates the feed guide into upper and lower sections 76, 78, that conforms to the opening of the cutting throat, and through which the molding section to be cut extends. It can readily be seen from FIGS. 4 and 4*a* that as the cutting block strikes through the cutting throat it will cut a notch in the portion of the molding section exposed in the V-notch of the drop feed guide. As this occurs, the upper and lower portions of the molding section adjacent the cutting throat are firmly held in place by the upper and lower sections 76, 78 of the guild. The molding section can additionally be supported firmly in its near vertical position as the section is being cut by holding the section against the projecting guide fence 80 which extends longitudinally along the work table inwardly from the table's outside edge 19.

The feed stop 63 below the drop feed guide is secured along its right side portion 64 to a bottom slide member 67*a* which similar to slide member 67 extends along the outside edge 19 of the worktable such that the feed stop can be adjusted upwardly or downwardly along the edge of the table. The left hand portion 66 of the feed stop extends outwardly from the lower slide member to receive the bottom end of the molding section held in the drop feed guide 61. The feed stop's top surface 68 is shown as being inclined at an angle that corresponds to the angle of the miter cut produced by the cutter block so that the bottom end of the molding section, as it passes through the feed guide during successive cutting operations, will mate with this stop surface.

The feed stop adjustment handle 65 consists of a slide base 72, securement knob 74 and pointer 70 and is situated above the drop feed guide 61 at a level that is easily seen by an operator standing in front of the machine. The adjustment block is vertically adjusted along the slide member 67 by simply loosening the securement knob and sliding the block to a desired position. A scale 81 extends along the edge of the slide member 67 and is calibrated such that the adjustment block pointer indicates the distance between the feed stop and the cutting throat to indicate the length of the cut piece of molding positioned in the drop feed guide. For the purpose of readily producing molding sections that can be assembled into a picture or poster frame for framing pictures or posters of a preset size, the scale 67 is preferably calibrated to indicate the length of a the short inside edge, indicated by the letter "L" in FIG. 4, between the oppositely angled mitered ends of the cut molding piece.

As best illustrated in FIG. 2, the entire assembly of the work table 15, cutter block 29, cutter block carriage frame 45, and the drop feed guide means is secured in its approximate vertical orientation to the base 13 by rear support frame 83. The rear support frame additionally holds a scrap chute 85 which generally extends from the area behind and under the cutting throat 23 forwardly to the front of the mitering machine where the scrap chute feeds into a removable scrap bin 87 positioned slightly to the side of and just behind and below the bottom end 27 of the work table. The scrap chute is generally large enough to catch scrap pieces of molding propelled out of the throat by the cutting action of the cutter block. It feeds these scrap pieces into the scrap bin which can periodically be removed from the front of the machine by the operator or maintenance people.

OPERATION

To operate the drop feed mitering machine of the invention, an operator standing in front of the machine facing the work table 15 will first preset the feed stop 63 to the length of molding desired by loosening the knob 74 of the adjustment block 65 and sliding the adjustment block along the side member 67 until pointer 70 indicates on the scale 81 the desired dimension of the molding piece to be cut. By tightening the adjustment knob 74 the feed stop will be secured into position.

If the molding stock does not already have a mitered end from a prior mitering operation, the end of the molding stock can be trimmed by simply inserting the molding stock down into the feed guide over the cutting throat and, while holding the molding section against the work table 15 and guide fence 80, cutting off the end in the cutting operation described below.

With the end of the molding stock trimmed, the molding stock is allowed to fall freely through the feed guide until its bottom is received by the preadjusted feed stop. The cutter block advance lever 41, which initially should be rotated downwardly to a clockwise position, is then rotated counterclockwise in a small increment to position the cutter block to take a relatively small notch cut in the molding stock that is held over the cutting throat. To make a cut, the operator simply depresses the foot pedal 47 causing the cutter block to strike through the molding section. When this is done, the cutter block advance lever is then moved forward to advance the cutter block into the throat an additional incremental distance, and a new cut is made by again pressing the foot pedal. By making successive cuts as shown in FIG. 4*a* the molding will be severed with the upper and lower severed pieces 89, 91 of the molding having clean matching mitered ends.

After the cutting operation above-described is complete, the lower molding piece 91 is removed by the operator and the remaining upper piece is allowed to fall through the feed guide into the feed stop for a new cut. In this manner, successive cuts of the molding stock can be made quickly and entirely by operating the machine while standing in front of its vertical work table.

Therefore, it is seen that the present invention provides an improved mitering machine which can be efficiently operated within relatively confined spaces by means of a relatively easy drop feed operation and which produces mitered molding sections of a quality equal to mitered sections cut in conventional horizontal work plane. Although the invention has been described above in considerable detail in the foregoing description of the preferred embodiment, it shall be understood that the invention is not intended to be limited to such detail, except as necessitated by the following claims.

What I claim is:

1. A drop feed mitering machine comprising (a) a base, (b) an elongated work table extending upwardly from said base in a near vertical orientation, said work table having top and bottom ends and a front work plane that defines the front of said machine, (c) a cutting throat running through said table intermediate the top and bottom ends thereof, (d) a cutting element moveably mounted to pass through said cutting throat, (e) means accessible from the front of said machine for causing said cutting element to pass in a cutting action through said cutting throat, (f) means accessible from the front of said machines for drop feeding a length of molding downwardly along the front plane of said work table over said cutting throat to a preadjusted position whereby said cutting element can by actuated to cut the molding to yield a cut piece of molding of a predetermined length.

2. The drop feed mitering machine of claim 1 wherein said drop feeding means includes a drop feed guide mounted to said work table in the region of said cutting throat and a molding feed stop adjustably positioned substantially in the plane of said work table below said drop feed guide whereby the length of the cut piece from the molding held by said feed guide is determined by the adjusted position of said feed stop.

3. The drop feed mitering maching of claim 2 wherein said drop feed guide is comprised of a guide block having upper and lower sections extending, respectively, above and below said cutting throat, and a guide channel through said upper and lower guide block sections formed to receive and guide a length of molding therethrough, said upper and lower guide block sections and the guide channel therethrough being separated by a notch in said guide block positioned over said cutting throat.

4. The drop feed mitering machine of claim 3 wherein said drop feeding means further includes a feed stop adjustment means accessible from the front of said machine above said feed guide whereby said adjustment means can easily be reached by an operated standing in front of the machine.

5. The drop feed mitering machine of claim 4 wherein a calibrated scale and visual including means associated therewith are provided on the front plane of said work table above said feed guide for indicating the position of said feed stop whereby the feed stop position can readily be determined visually from a standing position in front of the machine.

6. A drop feed mitering machine comprising (a) a base, (b) an elongated work table extending upwardly from said base in a near vertical orientation, said work table having top and bottom ends, a first inside edge, second outside edge, and a front plane, wherein the front plane defines the front of said mitering machine, (c) a V-slot extending into said work table from the first inside edge thereof and intermediate the top and bottom ends thereof, the apex of said V-slot forming a cutting throat running perpendicularly through said table, (d) a V-shaped cutter block moveably mounted to pass through said V-slot to provide a cutting action through said cutting throat which is perpendicular to said work table, (e) means accessible from the front of said machine for actuating said cutter block to strike in a cutting action through said cutting throat, (f) means accessible from the front of said machine for incrementally advancing said cutter block substantially in the plane of said work table into the cutting throat of said V-slot, (g) a drop feed guide mounted to said work table in the region of said cutting throat, said drop feed guide being accessible from the front of said machine and being adapted to guide a length of molding fed therethrough downwardly along the plane of said work table over said cutting throat, and (h) a molding feed stop adjustably positioned substantially in the plane of said work table below said drop feed guide whereby said cutter block can be actuated to cut a length of molding held by said feed stop and in said feed guide to yield a cut piece of molding of a predetermined length.

7. The drop feed mitering machine of claim 6 wherein said drop feed guide is comprised of a guide block having upper and lower sections extending, respectively, above and below said cutting throat, and a guide channel through said upper and lower guide block sections formed to receive and guide a length of molding therethrough, said upper and lower guide block sections and the guide channel therethrough being separated by a V-notch in said guide block positioned over said cutting throat.

8. The drop feed mitering machine of claim 7 further including feed stop adjustment means accessible from the front of said machine above said feed guide.

9. The drop feed mitering machine of claim 8 wherein said feed stop adjustment means includes (a) a slide member extending along the outside edge of said work table, (b) a feed stop adjustment handle slidably secured to said slide member above said feed guide and adapted to be locked in selected positions along said slide member, and (c) a connecting rod linking said adjustment handle to said molding feed stop.

10. The drop feed mitering machine of claim 9 wherein a calibrated scale is provided along said slide member above said guide block and visual indicating means are provided for indicating on said scale the position of said adjustment handle on said slide member whereby the feed stop position can readily be determined from the front of the machine in a standing position and whereby the length of the molding piece to be cut can readily be adjusted.

11. The drop feed mitering machine of claim 10 wherein (a) the cutting action of said cutting block cuts a V-shaped notch through the width of the molding piece being cut, (b) said V-shaped notch in turn produces opposed complimentary mitered ends of the severed molding pieces, (c) successive cuts of the molding by the cutter block, as the molding is fed through said feed guide block, produce a cut molding piece with mitered ends which in turn produce a molding piece having a short inside edge, and wherein (d) said scale is calibrated to indicate the length of the inside edge of a cut piece of molding between successive cuts.

12. The drop feed mitering machine of claim 6 further including a front accessible and removeable scrap bin and a scrap chute running from said cutting throat to said scrap bin for carrying scraps produced by the cutting action of said cutter block to said bin.

13. A drop feed mitering machine comprising (a) a base, (b) a elongated work table extending upwardly from said base in near vertical orientation, said work table having top and bottom ends, a first inside edge, and a second outside edge, and a front plane wherein the front plane of said work table defines the front of said mitering machine, (c) a V-slot extending into said work table from the first inside edge thereof and intermediate the top and bottom ends thereof, the apex of said V-slot forming a cutting throat running perpendicularly through said table, (d) a V-shaped cutter block moveably mounted to pass through said V-slot to provide a cutting action through said cutting throat which is perpendicular to said work table, (e) means accessible from the front of said machine for actuating said cutter block to strike in a cutting action through said cutting throat, (f) means accessible from the front of said machine for incrementally advancing said cutter block substantially in the plain of said work table into the cutting throat of said V-slot, (g) a drop feed guide mounted to said work table in the region of said cutting throat, said feed guide being accessible from the front of said machine and being adapted to guide a length of molding fed therethrough downwardly along the plane of said work table over said cutting throat, (h) slide member extending along the second outside edge of said work table, (i) a calibrated scale provided along said slide member above said drop feed guide, (j) a feed stop adjustment handle slidably secured to said slide member above said feed guide and adapted to be locked in selected positions along said slide member, said adjustment handle including a visual indicating means for indicating positions or said scale, (k) a molding feed stop adjustably positioned substantially in the plane of said work table below said drop feed guide, (l) a connecting rod linking said adjustment handle to said molding feed stop whereby the length of the cut piece of molding yielded by cutting the molding held in said feed guide is predetermined by adjusting the position of said adjustment handle, and (m) a front accessible and removeable scrap bin and a scrap chute running from said cutting throat to said scrape bin for carrying scraps produced by the cutting action of said cutter block to said bin.

14. The drop feed mitering machine of claim 13 wherein said work table is inclined rearwardly at an angle approximately ten degrees from vertical.

15. The drop feed mitering machine of claim 13 wherein said drop feed guide is comprised of a guide block having upper and lower sections extending, respectively, above and below said cutting throat, and a guide channel through said upper and lower guide block sections formed to receive and guide a length of molding therethrough, said upper and lower guide block sections and the guide channel therethrough being separated by a V-notch in said guide block positioned over said cutting throat.

16. The drop feed mitering machine of claim 15 wherein the guide channel of said guide block generally conforms in shape to the cross-sectional shape of the molding to be cut.

17. The drop feed mitering machine of claim 16 wherein said guide blocks are interchangeable to accommodate molding sections of different cross-sectional shapes and sizes.

* * * * *